United States Patent [19]

Kaplan

[11] 4,377,234

[45] Mar. 22, 1983

[54] MULTIPLE COMPARTMENT BANDING SLEEVE

[75] Inventor: Harold Kaplan, Franklin Square, N.Y.

[73] Assignee: Halpak Plastics Inc., Oceanside, N.Y.

[21] Appl. No.: 244,011

[22] Filed: Mar. 16, 1981

[51] Int. Cl.[3] ..... B65D 71/08; B65D 73/00; B65D 85/62

[52] U.S. Cl. ..... 206/432; 206/45.33; 206/497; 229/DIG. 12

[58] Field of Search ..... 428/36; 206/432, 216, 206/45.33, 805, 497; 229/DIG. 12

[56] References Cited

U.S. PATENT DOCUMENTS

| | | | |
|---|---|---|---|
| 3,110,554 | 11/1963 | Yazumi | 13/59 |
| 3,112,826 | 12/1963 | Blum | 206/142 |
| 3,523,052 | 8/1970 | Bolen | 156/521 |
| 3,823,814 | 7/1974 | Lum | 206/805 |
| 3,885,667 | 5/1975 | Spiegel et al. | 206/45.33 |

FOREIGN PATENT DOCUMENTS

| | | | |
|---|---|---|---|
| 2353048 | 5/1974 | Fed. Rep. of Germany | 206/497 |

*Primary Examiner*—William T. Dixon, Jr.
*Attorney, Agent, or Firm*—Mandeville and Schweitzer

[57] ABSTRACT

A multiple compartment banding sleeve is proposed in the form of a cylindrical band of heat shrinkable material, e.g., PVC, which is divided into two or more envelopes by longitudinal seams. The sleeve may be used to wrap, protect and display a grouping of similar or dissimilar items.

5 Claims, 3 Drawing Figures

MULTIPLE COMPARTMENT BANDING SLEEVE

BACKGROUND OF THE INVENTION

Cylindrical sleeves or tubes of a heat-shrinkable material, such as pre-expanded polyvinyl chloride, have been used to protect, to decorate, to band and/or to label items of various shapes and sizes. The sleeves have been placed around the items and shrunk into substantial conformity therewith by the application of hot air from a heat gun or shrink tunnel. The sleeves have been printed with decorative, advertising, and/or labeling matter. Prior art disclosing this type of heat-shrinkable PVC sleeve includes U.S. Pat. Nos. 3,110,554 and 3,523,052.

There have been limitations in this method when one sleeve has been used to band two or more items of non-rectangular cross-section for sale as a single unit. The single sleeve encircling both items has not always been in sufficient contact with the items at their peripheries, especially at or near the plane at which the items interface. Often, shrunken sleeves conformed only to a generalized outer perimeter and left gaps at the interstices between the items. As a result, dust and other contaminants could accumulate in the gaps, detracting from the appearance of the items and reducing and in some cases destroying their value. The variety of shapes of items which could be banded was limited. Printing or labeling on the items or on the sleeve could appear somewhat distorted or illegible when the band did not conform smoothly and tightly to the surface. There was also the problem that when the band was broken to allow one item to be used, the second item would be without protection, or labeling, if the band had served as the label.

SUMMARY OF THE INVENTION

To eliminate these shortcomings and to provide new advantages, in accordance with the principles of the invention, a sleeve of heat shrinkable material is formed into two or more substantially cylindrical envelope sections. To create this sleeve a cylindrical loop is divided into two or more sub-loops by a vertical seam traversing the sleeve. The sub-loops form envelopes that are fitted separately over a plurality of articles. Each envelope can then be heat shrunk to mold tightly to its own item, protecting it from dust and grime. Because each item is protected individually, there is no gap between the items such as exists when a single cylinder wraps two non-matching items.

In a preferred construction of this novel sleeve, the seams between the envelope are made with a line of perforation. By this means, one or more of the items may be removed and used, while the other items remain wrapped and protected. This is especially useful when three or more items are joined as a unit. Items of diverse size and shape may thus be readily joined in a multipack.

Underlying printing or design on an item will appear clearly and without the distortion that a single overlapping envelope might cause. In a cost-effective advantage, the process of fitting the items within the band and then shrinking the band does not require specific or careful positioning of the items nor does it limit the shapes of the banded items. Finally, a separate tag or label may be held onto each item by its own envelope. This is a distinct improvement over first attaching the labels by separate shrinkable bands and then joining the two items by yet another band.

DETAILED DESCRIPTION OF THE INVENTION

In the following description, reference will be made to an exemplary embodiment having two envelopes. It will be understood, of course, that the number of envelopes can be varied, as will be described.

Figure 1:
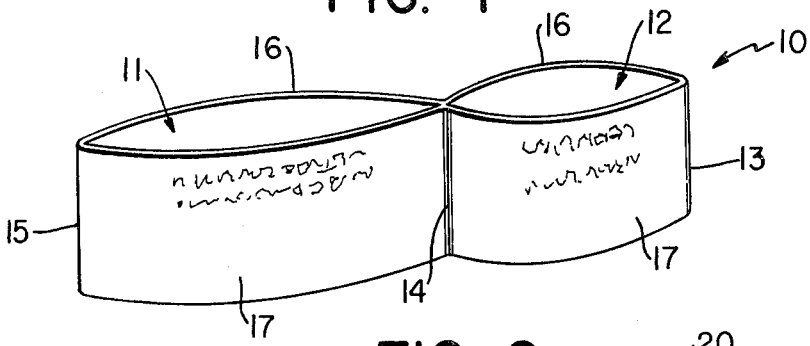
FIG. 1 is a perspective view of a multiple compartment sleeve embodying the present invention.

In FIG. 1, the sleeve 10 is shown in its unshrunken form. The sleeve 10 is made of suitable heat-shrinkable material, such as polyvinyl chloride. Two cylindrical envelopes 11 and 12 are fabricated from a continuous web in the following manner. The web is initially folded along a fold line 13 and two seals 14 and 15 are formed longitudinally. These seals 14 and 15 join the opposing sides 16, 17 of the web and maintain their sealing effect even after the sleeve 10 is subsequently shrunk.

The divider seal 14 may be placed at any desired position across the sleeve 10. For instance, in FIG. 1 seal 14 divides the sleeve 10 into unequal sections. It could have alternatively divided the sleeve 10 in half. This construction would be appropriate for two items of approximately equal girth, although in accordance with the invention the shapes may be very disparate. It will be understood that the placement of the seal 14 can be varied to change the relative size and girth of the envelopes 11, 12, as is desirable for the particular sizes and shapes of items to be packed. However, each envelope is large enough before shrinking to surround its item easily, so that careful positioning and flat, face-to-face contact of banded items is not required.

Figure 2:
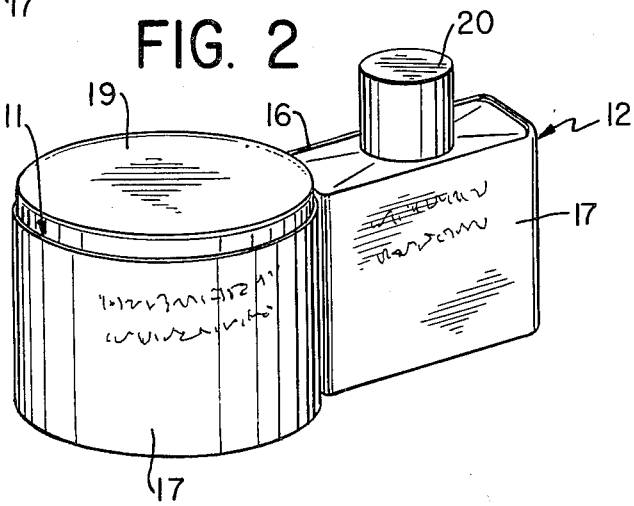
FIG. 2 is a perspective view of a multiple compartment sleeve that has been shrunk to conform to two differently shaped items.
Figure 3:
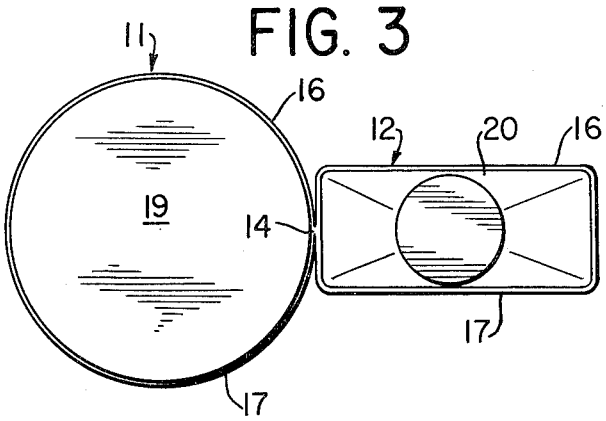
FIG. 3 is a top plan view of the sleeve of FIG. 2.

FIGS. 2 and 3 show the sleeve 10 in use after it has been heat shrunk to fit two disparate items 19 and 20. The heat may be conventionally supplied by hot air with a heat gun or shrink tunnel. The sleeve 10 molds tightly to the items 19, 20, conforming to their individual shapes. The items 19 and 20 are not in direct contact with each other, and therefore no gap between them exists to allow dust and grime to accumulate. Instead, each is completely wrapped by its own envelope, and the only line of contact is seal 14, so that the items are held closely and securely, but separately.

When a line perforation is placed within the seal 14, as shown in FIG. 3, one or both of the items may be removed at thee consumer's pleasure. However, if only one is removed, the other remains securely wrapped and safely protected. This is a valuable advantage over the former method of using the single envelope or sleeve to wrap two or more items. Using the present invention, each item is fully protected until it is used. Additionally, when the separate envelope is printed with labeling information, when it secures a separate label or the like, the remaining item will retain its identification.

A further advantage of this novel sleeve is that it will hold two irregularly-shaped items upright steadily, so that they will not topple or canter, as they might with a single compartment sleeve.

The benefits of separate protection and separate labeling make this new sleeve commercially preferable and functionally distinct for many applications, especially when items of disparate shapes are banded. If it is desired to hold three or more disparate items together, this may be accomplished through the provision of additional seals.

It will be appreciated that the novel multi-compartment sleeve of the claimed invention presents many useful and cost-effective advantages and new applications.

I claim:

1. A packaging sleeve comprising (a) a pair of opposed walls of non-elastic, heat shrinkable thermoplastic sheet material hinged at opposite ends to form a flattened tube having a predetermined center line;

(b) a vertical welded seam parallel to and spaced from said center line joining said walls intermediate said ends;

(c) said vertical seam dividing said sleeve into two separate envelopes of unequal size; and (d) said separate envelopes being adapted to be independently shrunk about two adjacent dissimilar objects with said seam disposed as an axis of interfacing to retain said objects in a predetermined generally abutting relationship.

2. A multi-compartment packaging sleeve, comprising (a) a web of non-elastic heat shrinkable material;

(b) said web being folded over itself lengthwise in half, forming two layers;

(c) at least two seals traversing said web, joining the two layers;

(d) said seals dividing said web into individual lengthwise sections of unequal size; and (e) said sections of unequal size being adapted to be independently shrunk about adjacent dissimilar objects with said seam disposed as an axis of interfacing to retain said objects in a predetermined generally abutting relationship.

3. A sleeve according to claim 1 or claim 2, wherein said heat shrinkable material is polyvinyl chloride.

4. A packaging sleeve, in accordance with claim 1, further characterized in that (a) one of said objects has a generally circular cross-section, while the other of said objects has a generally rectangular cross-section;

(b) the perimeters of said envelopes being slightly greater than the perimeters of said objects.

5. The sleeve of claim 4, in which (a) the longitudinal axis of the rectangular cross-sectional object is adapted to be co-linearly aligned with the diameter of said generally circular cross-sectional object.

* * * * *